US005934380A

United States Patent [19]

Finnerty et al.

[11] Patent Number: 5,934,380

[45] Date of Patent: Aug. 10, 1999

[54] APPARATUS FOR PREPARING AND DISSEMINATING NOVEL FIRE EXTINGUISHING AGENTS

[75] Inventors: Anthony E. Finnerty, Forest Hill; Warren W. Hillstorm, Joppa; Lawrence J. Vande Kieft, Street, all of Md.

[73] Assignee: The United States of America as represented by the Secretary of the Army, Washington, D.C.

[21] Appl. No.: 08/812,062

[22] Filed: Feb. 19, 1997

[51] Int. Cl.[6] ..... A62C 2/00

[52] U.S. Cl. ..... 169/46; 169/9

[58] Field of Search ..... 169/46, 9

[56] References Cited

U.S. PATENT DOCUMENTS

| | | | |
|---|---|---|---|
| 2,841,227 | 7/1958 | Betzler | 169/9 |
| 4,505,336 | 3/1985 | Thevis et al. | 169/9 |
| 4,622,209 | 11/1986 | Nardi et al. | 169/9 |
| 5,676,210 | 10/1997 | Sundholm | 169/9 |

*Primary Examiner*—Gary C. Hoge
*Attorney, Agent, or Firm*—Paul S. Clohan, Jr.; U. John Biffoni

[57] ABSTRACT

Apparatus including two containers, two liquids or liquid mixtures pressurized within the containers, a blending section for dispersing intimately one liquid into the other, and a nozzle providing sufficient flow resistance so that the moieties remain liquid in the blending section, and vaporization of the vaporizable moiety occurs within and/or beyond the nozzle.

11 Claims, 2 Drawing Sheets

APPARATUS FOR PREPARING AND DISSEMINATING NOVEL FIRE EXTINGUISHING AGENTS

GOVERNMENT INTEREST

The invention described herein may be manufactured, used and/or licensed by or for the United States Government.

BACKGROUND OF THE INVENTION

FIELD OF THE INVENTION

The present invention relates to fire extinguishers and compositions suitable for use in fire extinguishers, particular suspensions including a fire extinguishing material and a carrier disseminated in a high volume and uniform suspension (which may or may not be an emulsion) of very fine droplets of a liquid agent, and a gaseous component, the gaseous component providing the propulsion for the suspension, wherein the gaseous component as a carrier in addition to the liquid agent as a fire extinguishing material are both effective in extinguishing fire.

DESCRIPTION OF RELATED INFORMATION

Fire extinguishing agents are stored in a single condensed phase, in a container, pressurized with their own vapor pressure and/or the pressure of an additional gas. Agents currently are chosen from the following set of materials: water with or without an antifreeze agent, $CO_2$, various dry powders, and various halons and other halocarbons (including hydro-halocarbons). Agents may also be stored in an unpressurized condition, and pressurized when used, e.g., water-acid-soda extinguishers and gas-generating cartridges used to expel extinguishing agents upon demand. Misting agents such as water have been shown to be highly efficient in extinguishing fires; however, because of the high aerodynamic drag of small particles, there is an unsolved problem in making them fill an enclosure as well as a vaporizing material, such as Halon 1301 or $CO_2$ fills an enclosure. At room temperature, the fire extinguishing agents, Halon 1301 and $CO_2$ are stored as liquids in pressurized containers. The equilibrium vapor pressure of $CO_2$ is about 700 psi, and that of Halon 1301 is about 200 psi. When the valve of either container is opened, gaseous material is expelled, and the remaining liquid quickly vaporizes and is discharged from the container. As the vapors enter the air, they tend to completely and quickly permeate the entire volume. Both of these materials are available from any fire extinguisher supply company, e.g., Kidde-Graviner. Dual-flow nozzles, used to shear relatively large liquid droplets into fine droplets, are an attempt to overcome the problems of producing a large volume of fine droplets, and propelling them through air. However, these nozzles, which require that one of the fluids be a gas to assist in formation of the small droplets, produce a directional flow of fine particles and do not solve the problem of filling a volume with small droplets of the agent.

SUMMARY OF THE INVENTION

The present invention is an improvement over existing fire extinguishing devices and agents in that it will disseminate a high volume and uniform suspension (which may or may not be an emulsion) of very fine droplets of a liquid agent, and a gaseous component, the gaseous component providing the propulsion for the suspension, wherein the gaseous component as a carrier in addition to the liquid agent as a fire extinguishing material are both effective in extinguishing fire.

The present invention allows the use of a wide variety of agents, all of which can be effective in extinguishing fire.

The present invention allows the use of agents not normally acceptable as flooding agents due at least in part because the concentration required to extinguish fires exceeds their NOEL's. As used herein, "NOEL" means a concentration determined by the Environmental Protection Agency (EPA) to be at a "no observable effects level", on personnel.

The present invention allows the use of reagents at concentrations below concentrations normally recommended when used independently of other agents.

In accordance with the present invention, the selected agents are disseminated as a mixture of two liquids. One of the liquids vaporizes immediately upon exiting the mixing section of the device, providing a propelling mechanism to disseminate the fine droplets of the other liquid throughout the volume.

The present invention is based, at least in part, on the discovery that a liquid fog, being disseminated by itself, encounters a large amount of drag in passing through the atmosphere, and thus has difficulty in rapidly filling a volume.

The present invention provides the means of forming a suspension of fine liquid droplets in a carrier component which is a vaporizable material, which upon vaporizing provides the power to disseminate itself and the fine droplets throughout the entire volume being protected.

The present invention unexpectedly provides a means of forming a suspension of fine liquid droplets in a carrier component which is a vaporizing material that is not adversely affected by such phenomenon of fog.

Although not wishing to be bound by any particular theory, the non-flammable, vaporizing component carries the fine droplets along with it as it vaporizes, and fills an enclosure (in much the same manner as Halon 1301 fills an enclosure) with the effects of this expanding, vaporizing component believed to be pushing the air out of the way, whereby, the droplets being entrained in the expanding moiety, are carried along with it. This ensures very rapid dissemination into all the nooks and crannies of the desired spaces; and, thus, rapid application to the fire.

In accordance with the present invention, the gaseous or vaporizing moiety is most preferably also an extinguishing agent, thus providing a synergistic effect in extinguishing the fire.

The present invention is advantageous for a number of reasons as discussed herein.

For example, the present invention allows an environmentally acceptable agent, such as water, water with potassium lactate, water with potassium acetate, and water with calcium chloride, all of which may include emulsifying agents, in addition to non-water liquids, such as high boiling point bromine-containing liquid, to be used in an efficient manner, as finely divided droplets which have been shown to be very efficient in extinguishing fire.

The present invention also provides enhancement of fire extinguishing power of all components, i.e., the vaporizing component drives the small suspended droplets of the non-vaporized component throughout the volume.

The present invention allows the vaporizing component to be used in a low concentration, enhancing the safety of the overall process. Normally carbon dioxide is used in approximately 40% concentration in air to ensure extinguishment of all fires. Carbon dioxide ($CO_2$) is not recommended as a gaseous flooding agent in normally occupied spaces since deleterious effects on people are noted at concentrations as low as 5%. Since this invention employs the vaporizing material, such as $CO_2$, principally as a means of transporting water-based droplets, it has been computed that the resulting $CO_2$ concentrations can be kept as low as 3% in air.

The present invention allows the use of agents which are non-corrosive and non-toxic. Agents which are non-corrosive and non-toxic include vaporizing agents selected from a group consisting of $CO_2$; 1,1,1,2,3,3,3, heptafluoropropane (FM 200 which is a trade mark of Great Lakes Chemical Co.); perfluoropropane; and, perfluorobutane. All of such agents can be used to disseminate the water-based droplets completely throughout an enclosure, keeping the concentration of the vaporizing agent sufficiently low as to preclude toxicity problems. Suitable agents also include non-vaporizing agents selected from a group of aqueous solutions consisting of water; solutions of potassium lactate in water; solutions of potassium acetate in water; and solutions of calcium chloride in water.

The present invention allows the use of a vaporizing agent in a low enough concentration to qualify for the EPA's Significant New Alternatives Policy (SNAP) criteria for inhabited spaces. The EPA will allow the use of agents in occupied spaces up to their "No Observable Effects Level" (NOEL) concentration. For FM 200 in an occupied space, this maximum allowable concentration should be about 8.1%. Both perfluorobutane and perfluoropropane can be used effectively as carriers of the liquid droplets in relative concentrations of approximately 3% in air, which is well below any toxicity level. While $CO_2$ is not currently recognized by the EPA as a flooding agent for occupied spaces, the concentration of $CO_2$ required by this invention will be sufficiently low that future acceptance by the EPA is considered highly probable. Currently, the Army Surgeon General considers 0–3% $CO_2$ in air as low risk. This invention will allow the use of agents not normally allowed as total flooding agents in occupied spaces. Since the vaporizing agents are principally used as carriers of liquid droplets, the vaporizing agents can be used in amounts well below their NOEL concentrations or their recommended concentrations when used in amounts well below their NOEL concentrations or their recommended concentrations when used alone as fire extinguishing agents. An agent such as pentafluoroethane can be used well below its NOEL of 7.5%. An agent such as trifluoromethane can be used in concentrations well below its extinguishing concentration of 12% as reported by the DuPont Company. Even though these agents will be used in concentrations well below their fire extinguishing concentrations, a significant synergistic effect is expected when used as carriers of liquid droplets.

The present invention allows the use of agents, such as water, which can absorb and/or adsorb noxious combustion products keeping the protected space habitable to personnel. Noxious combustion products which can be absorbed/adsorbed by water include members selected from the group consisting of $CO_2$, CO, HCI, HCN, and aerosolized particulate matter.

For purposes of the present invention, if water is one of the extinguishing agents, it may contain a freezing point suppression agent to provide all-weather capability to the device and agents.

DETAILED DESCRIPTION OF THE INVENTION

Figure 1:
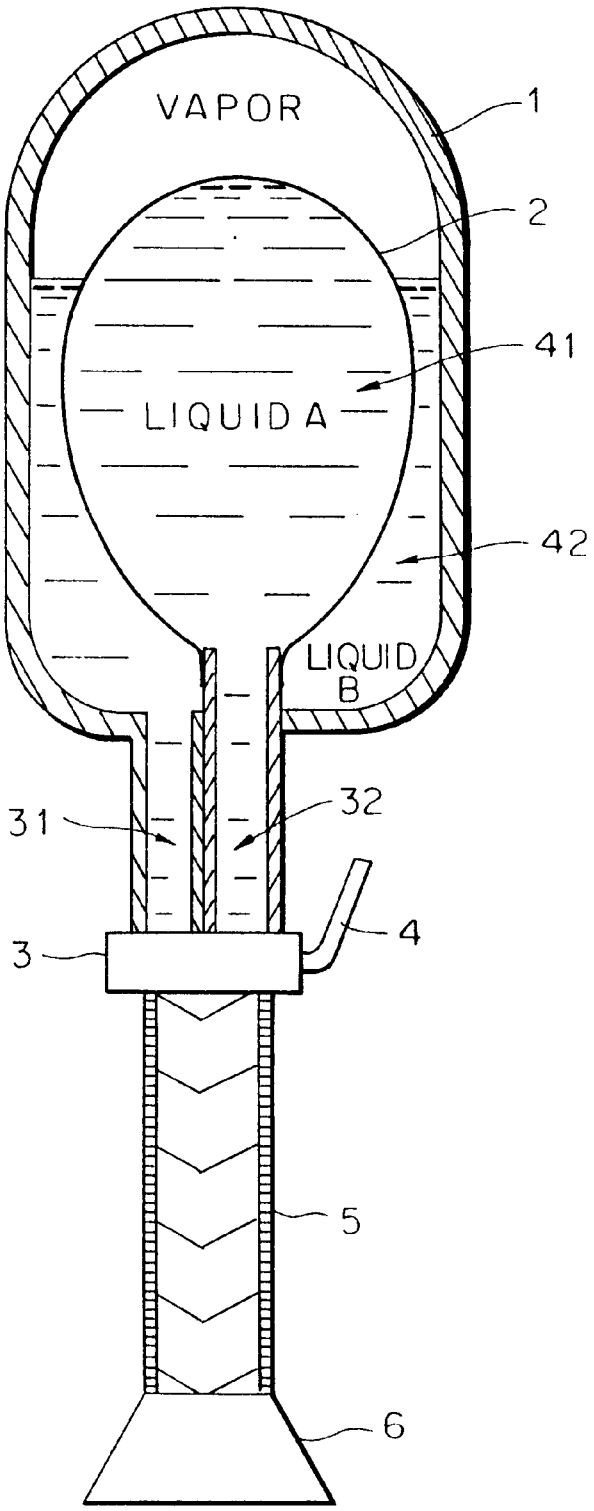
FIG. 1 shows one embodiment of the present invention.

The following is a description of the present invention which is intended to be claimed.

In general, for purposes of the present invention, at least two, and most preferably two, containers are used wherein one container contains a fluid as a liquid agent, such as water, preferably with various additives, and the other container contains a pressurized fluid as a vaporizable liquid, such as $CO_2$.

For purposes of the present invention, either the liquid agent or the vaporizable agent, or both, may contain emulsifiers to aid in the formation of fine droplets of the liquid agent in the vaporizable component.

Notwithstanding the drawings provided merely as an illustrative example, not meant to limit the invention, the containers may be configured in many different ways, e.g., one within the other, in which case the internal container is preferably flexible, or separately disposed with respect to each other, e.g., side-by-side. Also, each of the containers may be rigid, although herein, Reynold's number is meant to be interpreted in accordance with standard dictionary definitions, eg. as a nondimensional parameter used to determine the nature of fluid flow along surfaces and around objects In accordance with the present invention, the water is also pressurized appropriately so as to blend properly in the mixing device when the fire extinguisher is activated.

For purposes of the present invention, the mixing device can be motionless mixer which is designed so that, given the parameters of density, viscosity, and flow rate of the fluids, it will provide the proper Reynold's Number for turbulent mixing, to ensure optimal blending of the two moieties. As used in the embodiment illustrated in FIG. 1 container 2 is preferably flexible.

A dynamic mixing device can also be utilized. Dual feeds are most preferably used in the normal implementation of the present invention; however, multiple feeds can be used if, for example, it is desired further to isolate particular agents and/or additives. A single mixer is normally used for the present invention; however, multiple parallel mixers can be used to increase the flow rates of the extinguishing agents, or to reduce the time for complete functioning.

The mixer functions to affect a suitable degree of mixing. Other embodiments include a wide variety of mixers, e.g. freely rotating or driven elements within the fluid stream, coupled with or used independently from ultrasonic excitation or other forms of agitation. The mixers may be heated or cooled to enhance the degree of intimacy of the moieties.

Although not wishing to be bound by any particular theory, it is believed that there exist two almost-independent aspects to this invention: mechanical and chemical.

The mechanical aspect of this invention comprise the following components: two containers in any of various configurations, a mixer or mixers, a nozzle or nozzles, valves and the plumbing required to mate these elements into an integrated system.

The chemical aspect comprises two liquids, one of which becomes a vapor when the system is activated under all conditions of use. The vaporizable agent may have the ability to undergo chemical reactions in a flame zone, aiding in extinguishment of fire. The agent which is disseminated as liquid droplets may contain chemicals which are capable of interfering with the chemistry of flame, also aiding in extinguishment. However, one of the fluids may partially vaporize during transit.

For purposes of the present invention treatment parameters are tabulated below:

TABLE 1

| PARAMETER | SUITABLE | MORE PREFERRED | MOST PREFERRED |
|---|---|---|---|
| Temperature (C) | −60 to +100 | 0 to 60 | 15 to 30 |
| Discharge Times (Sec) | 0.01 to 20 | 0.01 to 15 | 0.01 to 10 |
| Density (g/cc) As stored | | | |
| Agent 1 | 1 to 2 | 1 to 2 | 1 to 2 |
| Agent 2 | 0.6 to 1.7 | 0.6 to 1.7 | 0.6 to 1.7 |
| Flow Rate (liters/s per mixer) | | | |
| Agent 1 | 0.1 to 50 | 0.1 to 50 | 0.1 to 50 |
| Agent 2 | 0.1 to 50 | 0.1 to 50 | 0.1 to 50 |

Referring to FIG. 1 for one possible implementation of this invention, element 1 is a rigid chamber, vessel or other suitable container, capable of withstanding internal pressures of at least 1500 psi (10.2 Mpa/102 bar). Both agents (agent 1 and agent 2) should be stored at the same pressure. Stored pressures are approximately, at room temperature, 700 psi for $CO_2$ (Agent 2). The system is usually arranged so as to provide the same pressure to both agents during dissemination. When activated, both agents, as they exit the mixer, return to ambient pressure, so the differentials are approximately 700 psi. Agents other than $CO_2$ will likely be at lower pressure. These agents will likely be overpressurized with an inert gas to achieve 600 to 700 psi at room temperature. Element 2 is preferably a flexible chamber, vessel or other suitable container, itself shown as being contained within container 1, ensuring that both chambers are at the same pressure. Suitable conduits 31 and 32, such as tubes lead independently from elements 1 and 2 to a valve, element 3, external to the containers. Valve 3 is operated by trip lever, element 4. Beyond valve 3, the tubes 31,32 lead into a motionless mixer, element 5.

Figure 2:
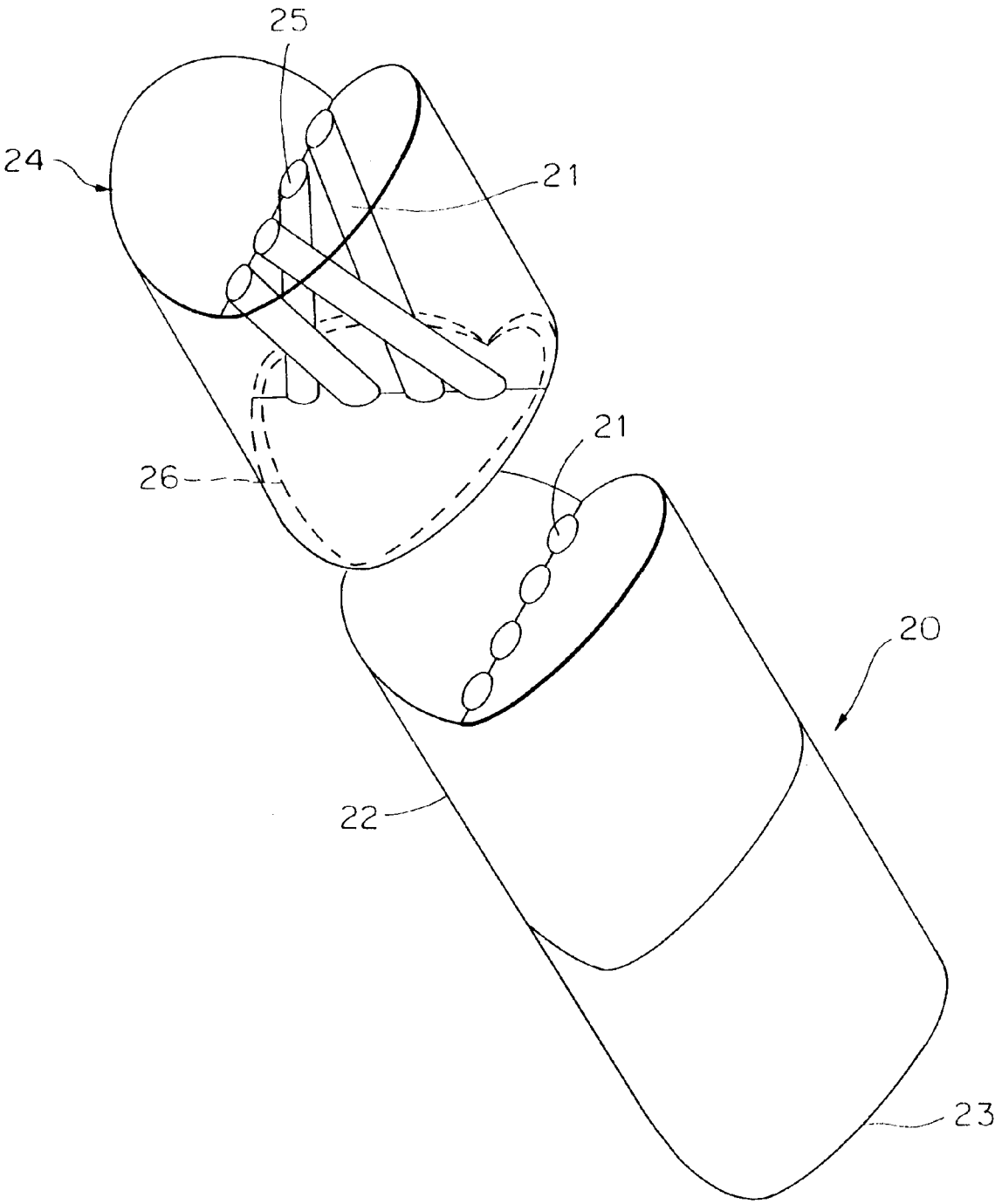
FIG. 2 shows a schematic of the mixer of the present invention.

FIG. 2 shows details of a suitable commercially available mixer 20, model ISG (Interfacial Surface Generator), made by Ross Engineering of Savannah, Ga., which is preferably used as motionless mixer element 5 shown in FIG. 1. This mixer includes a set of mixing elements 21 contained within a close-fitting tube 22, with a plenum chamber at the input end 23, and a nozzle (not shown) at the output end 24. The mixing elements 21 consist of solid material, usually steel, through which multiple channels 25 have been formed. These channels rotate the flow by 90 degrees per mixing element. Between elements, there is a small intermediary chamber 26. Fluid flows from the channels in an early mixing element, through the mixing chamber, and into the channels of the following mixing element. Turbulent flow exists because of the high Reynold's number. The net effect of this process is to sequentially divide the streams of the individual agents into increasingly smaller spatial volumes, resulting in a completely intimate mixture or blend. Due to the very low mutual solubility, the agents remain essentially discrete. Upon exiting the mixer and flowing into the nozzle, the volatile agent will flash into gaseous form, entraining and propelling the less volatile agent into and permeating the volume to be protected. This mixer is configured to have tubes which take the separate fluids as liquids and blend them into a finely divided mixture of two liquids. Each element of the mixer repetitively mixes the two liquids until an optimal mixture has been formed. This is achieved by using multiple elements which are placed in tandem along a common axis, each succeeding element being angularly offset from the preceding elements by °/2 rad (90°).

In a generic vortex blender, all fluids which are at least two in number, and most preferably comprise two fluids, are directed into an initial plenum chamber before entering the first mixing element. By adjusting the parameters of viscosity, density, and flow velocity, turbulent mixing results, with the flow field being repeatedly partitioned as it transits from element to element. Adjustable parameters are set for optimal operation in the normal window of operation, viz., prevailing flow rates, pressures and temperatures. Flow rates yielding sufficiently high Reynold's Numbers to give turbulent flow are desired for good mixing. The valves(s) 3 can be either manually, electrically, hydraulically, pneumatically, operated. They must operate rapidly, and provide minimal flow resistance, as well as ensuring that all liquids are fed to the mixer simultaneously.

The final element of the system of the present invention is a nozzle 6. The nozzle 6 may include a wedge or similar device to split the effluent stream into several desired patterns of dispersion. Nozzle 6 is designed so as to finely comminute the fluid mixture, to produce a suspension of fine liquid droplets in the vaporizing moiety. Although not wishing to be bound by any particular theory, this comminution is believed to be enhanced by the physics of the situation because there appears to exist a strong pressure gradient between the mixer 5 and the outside atmosphere, such that as the liquid stream exits the nozzle 6, it experiences a rapid de-pressurization. Since one of the fluids is a liquid under pressure, gas at atmospheric pressure, it will tend to return to the gaseous state as it transits the nozzle 6. The depressurization is almost explosive, and since the mixing of the two fluids in their liquid state is very thorough, this explosive expansion of the one fluid into a gas will still further divide the other fluid into droplets of liquid.

At this point in the process, there exists a suspension of finely divided droplets of one liquid, entrained and being driven by the rapid expansion of the gas from the other liquid, and also by the momentum imparted by the initial expansion which takes place in the nozzle. This action ensures complete penetration of all adjacent spaces, and optimum application of both extinguishing agents onto the fire.

For purposes of the present invention, one of the fluids, also referred to herein as "the first agent", (agent #1) and shown in the drawings as Liquid A, also labeled 41, should have properties such that it is a liquid under all storage conditions and will remain a liquid upon dissemination into small droplets. In the simplest case, which uses water as the first agent, when the water droplets reach the fire zone, the water absorbs heat energy from the flame, mainly by heat of vaporization of water (540 cal/g). In the case of a chemically active liquid agent, the droplets will vaporize in the flame zone, forming a gas and/or solid particulates which may interact with the flame and extinguish it.

For purposes of the present invention, another of the fluids, also referred to herein as a second agent, (agent #2) shown in the drawings as Liquid B, also labeled 42, should be a vaporizable liquid at 25° C. If the vapor pressure of this agent is great enough to power the process, there will be no need for super pressurization of this agent. However, if the vapor pressure is too low, e.g., <40 atm, the agent will likely require super pressurization with an inert gas, such as nitrogen.

In accordance with the present invention, the two agents, eg. agent #1 and agent #2, must be chemically inert with respect to each other. The second agent, with or without super pressurization, provides the power to mix, expel and disperse both of the agents throughout the space to be protected.

A non-exclusive list of some of the materials that can be used as agent #1 include members selected from the group consisting of water; water with a freezing point suppressant, including members selected from the group consisting of calcium chloride, sodium chloride, potassium lactate, potassium acetate, and lithium chloride; water with a freezing point suppressant and a material to enhance its ability to extinguish flame, including members selected from the group consisting of potassium lactate, potassium acetate, potassium bromide, sodium bromide, calcium iodide, sodium iodide, potassium iodide, and water-soluble chemicals containing or including members selected from the group consisting of phosphorous, chlorine, bromine, boron, and nitrates, more preferably including members selected from the group consisting of potassium lactate or potassium bromide; water with a surfactant, including members selected from the group consisting of sodium stearate, potassium stearate, sodium palmitate, and potassium palmitate; water with a surfactant and a freezing point suppressant and a material to enhance its ability to extinguish flame; other liquids which can interfere with the chemistry of flames, leading to extinguishment; and suspensions of various materials, including members selected from the group consisting of graphite, antimony compounds, and liquid brominated organic compounds.

A non-exclusive list of some of the materials that can be used as agent #2 include members selected from the group consisting of $CO_2$, $SF_6$, 1,1,1,2,3,3,3 heptafluoropropane (FM 200); several other hydrofluorocarbons (HFCs), including members selected from the group consisting of 1,1,1,2,2,3,3,4,4 nonafluorobutane, 1,1,1,2,2,3,4,4,4 nonafluorobutane, pentafluoroethane, and trifluoromethane; fluorocarbons (Fcs), including members selected from the group consisting of perfluoropropane and perfluorobutane.

An example of a useable form of this invention is shown in FIG. 1. The apparatus is accordance with the present invention is shown as including a pressurized dual chamber container, holding separated agents with the first agent being about 6.5 kg of water. The second agent is about 6.5 kg of $CO_2$. The $CO_2$ at about 22.4° C. is a liquid in equilibrium with its own vapor pressure of 60 atm. The first agent, while separated from the $CO_2$ is pressurized by it. A diaphragm separates these materials from each other, and a valve prevents their release. Upon activation of the valve, the two agents flow separately into a vortex mixer, such as the ISG stainless steel mixer from Ross Engineering, described above. These amounts of agents could be used to protect a chamber of 27 $m^3$ volume.

The present invention is directed to apparatus comprising means for forming an intimate mixture of at least two materials which when injected into the air will extinguish a fire.

In accordance with the present invention, an intimate mixture of at least two or more materials rapidly expands to permeate an enclosure with finely divided particles of the moiety which is a liquid under standard conditions.

In accordance with the present invention, the power of the vaporizable liquid, through its own equilibrium vapor pressure will disseminate the other moiety; however, the vaporizable liquid may be super pressurized by the addition of another gas, such as nitrogen or argon, to disseminate the other moiety throughout the desired volume.

In accordance with the present invention, ultrasonic stimulation may be used to enhance the comminution of the liquid moieties.

In accordance with the present invention, surfactants may be used to enhance the effectiveness of emulsification of the two agents.

Although not wishing to be bound by any particular theory, the present invention is advantageous for neutralizing or absorbing toxic products which can be formed when many vaporizing agents (fluorocarbons, hydrofluorocarbons, or even halons themselves) are used to extinguish fires.

The present invention is also believed to be advantageous in avoiding the need for compatible storage of the active moieties, thus avoiding problems with undesirable ageing and reacting of ingredients.

The present invention is also believed to be advantageous in extinguishing fires in inhabited spaces without injurious effects to personnel.

As defined by the claims, the present invention is directed to an apparatus including at least two containers; at least two fluids; a blending section for dispersing intimately one fluid into another fluid; and a nozzle providing sufficient flow resistance so that the fluids comprise a liquid in the blending section, and one of the fluids comprises a vaporizable fluid within and/or beyond the nozzle.

In accordance with the present invention, one of said at least two containers comprises a substantially rigid container capable of withstanding pressure of at least about 1200 psi, and most preferably is capable of withstanding pressures of at least about 1,500 psi (102 MPa/102bar); and another of said at least two containers comprises a substantially flexible container, most preferably wherein said substantially flexible container is positioned within said one container.

The apparatus of the present invention also includes at least two conduits, wherein each of said conduits have one end connected to a respective one and another of said at least two containers, and have another end connected to a valve, preferably wherein the valve comprises a trip lever.

For purposes of the present invention, the blending section comprises a mixer, most preferably wherein the mixer comprises a motionless mixer; the nozzle comprises means for finely communicating a mixture of said at least two fluids, wherein one of said at least two fluids comprises a gas at atmospheric pressure, and wherein another of said at least two fluids comprises a liquid that remains substantially liquid under substantially all conditions.

The present invention is also directed to a composition comprising a suspension comprising an active agent and a carrier, wherein at least one of the active agent and the carrier of said suspension comprises an emulsifier, and most preferably wherein the active agent comprises a fire extinguishing liquid material, and wherein the carrier comprises a vaporizable material.

In accordance with the present invention, the fire extinguishing liquid material comprises finely divided droplets entrained in the vaporizable material, and the fire extinguishing liquid material comprises a material comprising properties such that said fire extinguishing liquid material remains substantially liquid under substantially all conditions. Preferably, the vaporizable material comprises a vaporizable liquid at a temperature of at least about −60° C., and most preferably at a temperature of at least about 25° C. Most preferably, the fire extinguishing liquid material and the vaporizable material are chemically inert with respect to each other. Preferably, the vaporizable material comprises about 30% to about 70% by total weight of said suspension.

For purposes of the present invention, the fire extinguishing liquid material is at least one member selected from the group consisting of water, a freezing point suppressant, a flame extinguishing enhancer, a surfactant, and a mixture of water and at least one member selected from the group consisting of a freezing point suppressant, a flame extinguishing enhancer, and a surfactant.

The vaporizable material is selected from the group consisting of carbon dioxide, $SF_6$, FM200, halogens, fluorocarbons, and hydrofluorocarbons.

The present invention is also directed to a method for disseminating suspensions comprising an active agent and a carrier, wherein the method involves pressuring at least two fluids within a pressurized enclosure, wherein one of said fluids comprises a liquid under substantially all conditions, and another of said fluids comprises another liquid vaporizable at atmospheric pressure; and disseminating the at least two fluids as a mixture of said liquid and the other liquid into an ambient atmosphere, wherein the other liquid vaporizes substantially immediately upon disseminating into said atmosphere and said liquid forms into substantially fine droplets in said vaporizing liquid, preferably wherein the active agent comprises a fire extinguishing liquid material, and the carrier comprises a vaporizable material.

For purposes of the present invention, the fire extinguishing liquid material comprises a material comprising properties such that said fire extinguishing liquid material remains substantially liquid under substantially all conditions; and the vaporizable material comprises a vaporizable liquid at a temperature of at least about −60° C., and most preferably at a temperature of at least about 25° C. Most preferably the fire extinguishing liquid material and said vaporizing material are chemically inert with respect to each other. Preferably, the vaporizing material comprises about 30% to about 70% by total weight of said suspension.

For purposes of the present invention, the fire extinguishing liquid material comprises at least one member selected from the group consisting of water, a freezing point suppressant, a flame extinguishing enhancer, a surfactant, and a mixture of water and at least one member selected from the group consisting of a freezing point suppressant, a flame extinguishing enhancer, and a surfactant; and the vaporizable material is selected from the group consisting of carbon dioxide, fluorocarbons, and hydrofluorocarbons, and most preferably from the group consisting of $CO_2$, $SF_6$, and 1,1,1,2,3,3,3 heptafluoropropane.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A method for disseminating suspensions, said method comprising:

pressurizing at least two fluids within a pressurized enclosure, wherein one of said fluids comprises an active agent which is a liquid under substantially all conditions, and another of said fluids comprises a carrier which is another liquid vaporizable at atmospheric pressure; and disseminating said at least two fluids as a mixture of said active agent and said carrier into an ambient atmosphere, wherein said carrier vaporizes substantially immediately upon disseminating into said atmosphere and said active agent forms into substantially fine droplets in said carrier.

2. The method of claim 1, wherein said active agent comprises a fire extinguishing liquid material.

3. The method of claim 1, wherein said carrier comprises a vaporizable material.

4. The method of claim 2, wherein said fire extinguishing liquid material comprises a material comprising properties such that said fire extinguishing liquid material remains substantially liquid under substantially all conditions.

5. The method of claim 3, wherein said vaporizable material comprises a vaporizable liquid at a temperature of at least about −60° C.

6. The method of claim 5, wherein said vaporizing material comprises a vaporizable liquid at a temperature of at least about 25° C.

7. The method of claim 3, wherein said fire extinguishing liquid material and said vaporizing material are chemically inert with respect to each other.

8. The method of claim 7, wherein said vaporizing material comprises about 30% to about 70% by total weight of said suspension.

9. The method of claim 2, wherein said fire extinguishing liquid material comprises at least one member selected from the group consisting of water, a freezing point suppressant, a flame extinguishing enhancer, a surfactant, and a mixture of water and at least one member selected from the group consisting of a freezing point suppressant, a flame extinguishing enhancer, and a surfactant.

10. The method of claim 3, wherein said vaporizable material is selected from the group consisting of carbon dioxide, fluorocarbons, and hydrofluorocarbons.

11. The method of claim 3, wherein said vaporizable material is selected from the group consisting of carbon dioxide, $SF_6$, and 1,1,1,2,3,3,3 heptafluoropropane.

* * * * *